US012473727B2

(12) United States Patent
L'Henaff et al.

(10) Patent No.: US 12,473,727 B2
(45) Date of Patent: Nov. 18, 2025

(54) SELF-CLEANING TOILET ASSEMBLY

(71) Applicant: AS America, Inc., Piscataway, NJ (US)

(72) Inventors: Jean-Jacques L'Henaff, New Canaan, CT (US); Ki Bok Song, Plainview, NY (US); Jacob Nitz, Brooklyn, NY (US); Alison J. Lyons, Jersey City, NJ (US); Paul Flowers, London (GB); Greg Reinecker, Brooklyn, NY (US)

(73) Assignee: AS America, Inc., Piscataway, NJ (US)

( * ) Notice: Subject to any disclaimer, the term of this patent is extended or adjusted under 35 U.S.C. 154(b) by 67 days.

(21) Appl. No.: 18/695,501

(22) PCT Filed: Sep. 30, 2022

(86) PCT No.: PCT/US2022/045316

§ 371 (c)(1),
(2) Date: Mar. 26, 2024

(87) PCT Pub. No.: WO2023/055981

PCT Pub. Date: Apr. 6, 2023

(65) Prior Publication Data

US 2025/0116097 A1 Apr. 10, 2025

Related U.S. Application Data

(60) Provisional application No. 63/251,564, filed on Oct. 1, 2021.

(51) Int. Cl.
*E03D 9/03* (2006.01)
*E03D 1/34* (2006.01)
(Continued)

(52) U.S. Cl.
CPC ..... *E03D 9/035* (2013.01); *E03D 1/34* (2013.01); *E03D 5/10* (2013.01); *E03D 9/037* (2013.01);
(Continued)

(58) Field of Classification Search
CPC .. E03D 9/03; E03D 9/035; E03D 1/34; E03D 5/10; E03D 9/037; E03D 2009/024; E03D 2009/028; E03D 2201/40
(Continued)

(56) References Cited

U.S. PATENT DOCUMENTS 6,772,450 B1 8/2004 Saylor et al.
11,613,882 B2 * 3/2023 Bucher ..... E03D 5/092 4/224

(Continued)

FOREIGN PATENT DOCUMENTS

WO WO-2023055981 A1 * 4/2023 ..... E03D 9/037

OTHER PUBLICATIONS

PCT Search Report, PCT/US2022/045316, Mail date Dec. 22, 2022, 2 pp.

*Primary Examiner* — Lori L Baker
(74) *Attorney, Agent, or Firm* — Anna-lisa L. Gallo; Tyler A. Stevenson

(57) ABSTRACT

A self-cleaning toilet assembly, configured to operate in a flush mode to perform a flush cycle to clear a toilet bowl of bowl contents, and to operate in an independent on-demand cleaning mode to perform a clean cycle to clean the bowl. The toilet assembly comprises a clean cycle actuator and a chamber housing coupled to a lower tank lid. The cleaning agent chamber may be positioned in the housing in an inserted position during operation of the toilet, and may be positioned at least partially extended out of the housing in order to refill the chamber with cleaning agent.

20 Claims, 5 Drawing Sheets

(51) Int. Cl.
*E03D 5/10* (2006.01)
*E03D 9/02* (2006.01)

(52) U.S. Cl.
CPC .. *E03D 2009/024* (2013.01); *E03D 2009/028* (2013.01); *E03D 2201/40* (2013.01)

(58) Field of Classification Search
USPC ..... 4/222, 223, 224, 227.1, 111.1, 220, 261, 4/294, 309, 459, 464; 210/632, 638, 660, 210/696, 702, 749, 198.1; 422/1, 243; 424/40, 76.1; 510/109, 406, 439, 382, 510/440, 447
See application file for complete search history.

(56) References Cited

U.S. PATENT DOCUMENTS

| | | | | |
|---|---|---|---|---|
| 2009/0211003 | A1 | 8/2009 | Harris | |
| 2012/0266920 | A1* | 10/2012 | Burt | E03D 9/032 4/224 |
| 2015/0013058 | A1* | 1/2015 | Bucher | E03D 9/037 4/224 |
| 2017/0030065 | A1* | 2/2017 | Bucher | E03D 9/032 |
| 2017/0058500 | A1 | 3/2017 | Garrels et al. | |
| 2020/0232200 | A1 | 7/2020 | Garrels et al. | |
| 2020/0340227 | A1 | 10/2020 | Bucher et al. | |
| 2022/0064929 | A1* | 3/2022 | Garrels | E03D 11/13 |
| 2022/0243443 | A1* | 8/2022 | Booth | E03C 1/1222 |
| 2023/0417037 | A1* | 12/2023 | Halloran | B05B 1/14 |

* cited by examiner

SELF-CLEANING TOILET ASSEMBLY

The disclosure is directed to a toilet assembly having a self-cleaning feature.

BACKGROUND

There are a variety of types of toilets and toilet assemblies having toilet bowls, including gravity-powered siphonic and wash down toilets. Siphonic toilets may include rim-fed bowls, non-jetted, rim-jetted and direct jetted bowls. Typically, toilets such as gravity-powered toilets generally have two main parts: a tank and a bowl. The tank and bowl can be separate pieces coupled together to form the toilet system (commonly referred to as a two-piece toilet) or can be combined into one integral unit (typically referred to as a one-piece toilet).

Toilet cleaning is a time-consuming, labor-intensive job. Desired is an "on-demand", automatic system configured to clean a toilet bowl interior surface.

SUMMARY

Accordingly, disclosed is a self-cleaning toilet assembly comprising a toilet bowl; a toilet water tank; a toilet water tank lid; a flush valve assembly; and a cleaning system, wherein the toilet assembly is configured to operate in a flush mode to clear the toilet bowl of bowl contents, the toilet assembly is configured to operate in an independent cleaning mode to clean the toilet bowl, the toilet bowl comprises a toilet bowl interior surface, the toilet water tank lid is configured to be positioned on and enclose the toilet water tank, the toilet tank lid comprises a upper lid and a lower lid, the flush valve assembly comprises a flush valve body having an interior space, a flush valve inlet, a flush valve outlet, and a seal, the flush valve assembly is configured to be in a closed position when the seal is positioned over the flush valve inlet, the flush valve assembly is configured to be in an open position when the seal is lifted off the flush valve inlet, the flush valve assembly is configured to direct toilet tank water to a rim outlet and into the toilet bowl, the cleaning system comprises a clean cycle actuator, a chamber configured to receive a cleaning agent, a housing configured to receive the chamber in a housing interior space, a flow assembly, and a controller, the clean cycle actuator and the housing are coupled to the lower lid, the housing and chamber are in flow communication, the clean cycle actuator and the controller are in electrical communication, the chamber is configured to be in an inserted position in the housing and to be in an extended position out of the housing, the chamber is configured to receive the cleaning agent when in the extended position, the cleaning mode comprises operating the clean cycle actuator to send a clean cycle request to the controller, the controller instructing the flow assembly to direct a dose of cleaning agent from the housing to the flush valve body interior space in the flush valve closed position, the controller instructing the flush valve to open to introduce tank water into the flush valve body interior space to carry the dose of cleaning agent as a water/cleaning agent mixture through the flush valve outlet, through the rim outlet, and onto the toilet bowl interior surface, the controller instructing the flush valve to close, the cleaning mode is configured to operate independently from the flush mode, and a flow rate and volume of the water/cleaning agent mixture are insufficient to initiate a flush to clear the toilet bowl of bowl contents.

In some embodiments, a flush cycle may be initiated by operation of a flush actuator, comprises flow of tank water through a rim outlet and/or a jet outlet to perform a bowl flush to empty the bowl of bowl contents, and concludes upon a bowl sump area being refilled to form a bowl water seal.

An independent clean cycle may be initiated by operation of a clean cycle actuator, comprises flow of a dose of cleaning agent to an interior space of a flush valve, and opening of the flush valve to carry the dose of cleaning agent as a water/cleaning agent mixture to the bowl upper perimeter and onto the bowl interior surface. A cleaning cycle may comprise allowing the water/cleaning agent mixture to sit on the bowl surface for a predetermined period of time, and conclude by instructing the flush valve to open after the period of time to rinse the water/cleaning agent mixture from the bowl surface.

In some embodiments, a chamber configured to receive a liquid or solid cleaning agent may be positioned in a housing, wherein the housing comprises a mechanism to aid in moving the chamber between an inserted position in the housing and in an extended position at least partially out of the housing. A mechanism may comprise a push-push mechanism, a click-pen mechanism, and the like. In some embodiments, a chamber comprises a cap removably coupled to an upper end thereof. In some embodiments, a chamber may comprise an opening positioned in a side-wall, configured to receive a solid cleaning agent. A chamber opening may be accessible when in an extended position.

BRIEF DESCRIPTION OF THE DRAWINGS

The disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
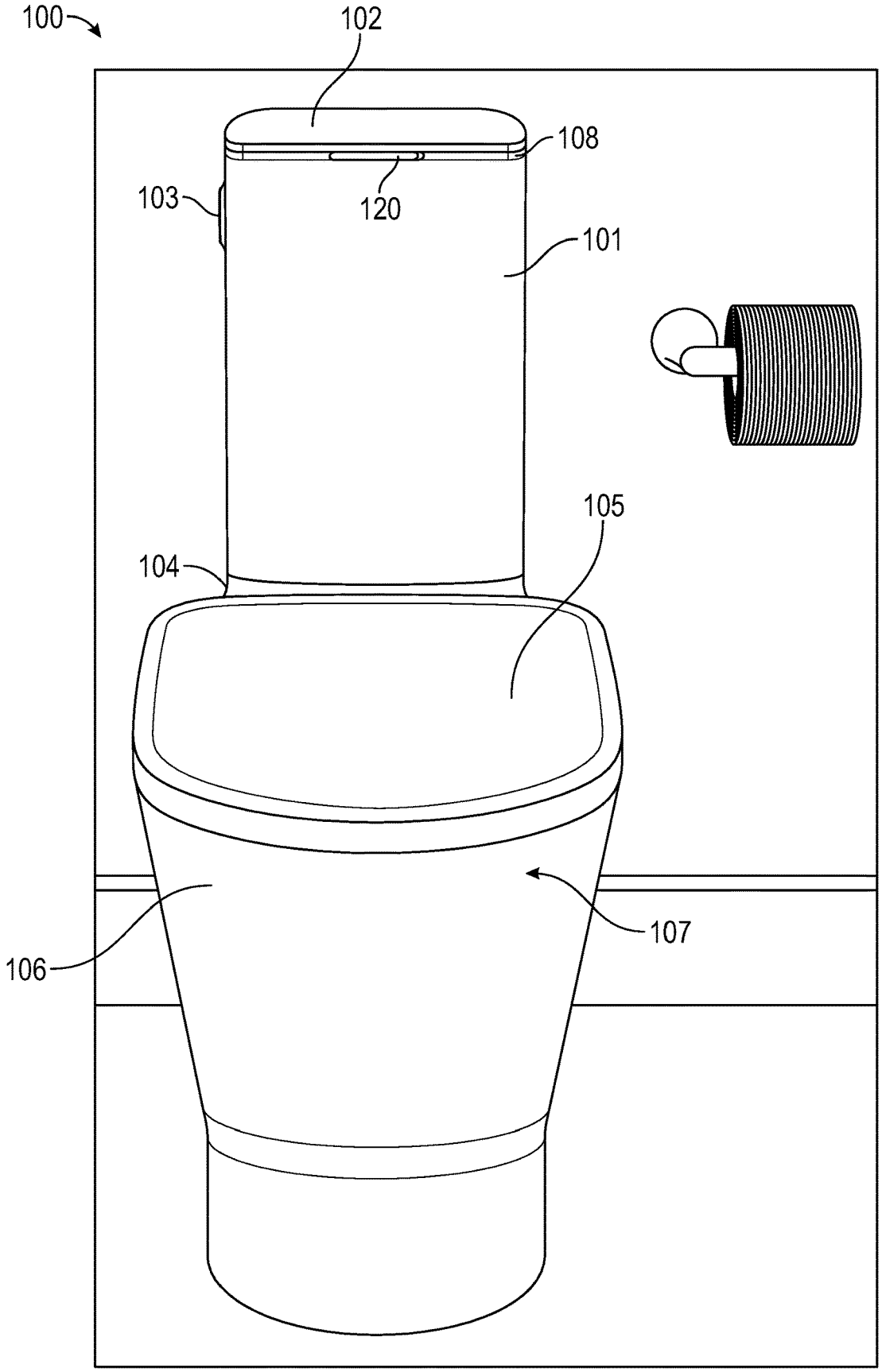
FIG. 1A shows a toilet assembly, according to some embodiments.

FIG. 1A shows toilet assembly 100, according to an embodiment. Toilet assembly comprises toilet water tank 101 having tank upper lid 102 positioned on a top surface thereof. Also positioned on tank 101 is flush actuator 103. Tank 101 is positioned on toilet deck 104. Also positioned on toilet deck 104 is toilet bowl lid 105. Toilet bowl 107 (not visible) is positioned under lid 105 within toilet base 106. Also visible is lower lid 108 and latch feature 120.

Figure 1B:
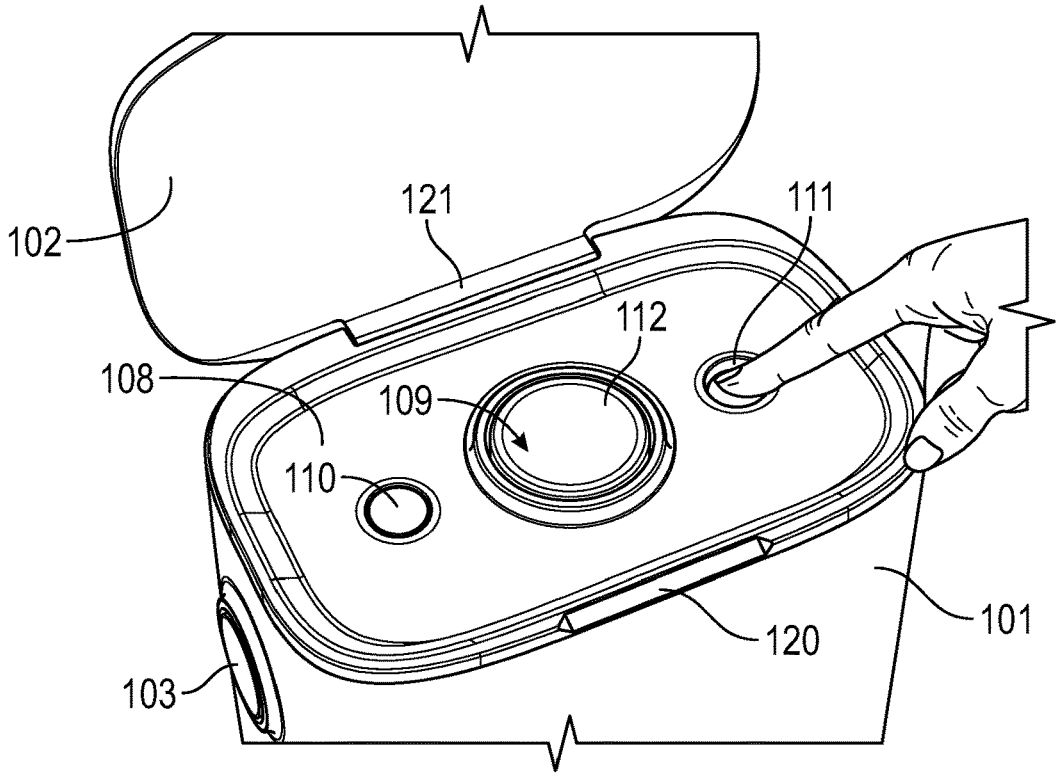
FIG. 1B and FIG. 1C provide views of a tank portion of a toilet assembly, according to some embodiments.
Figure 1C:
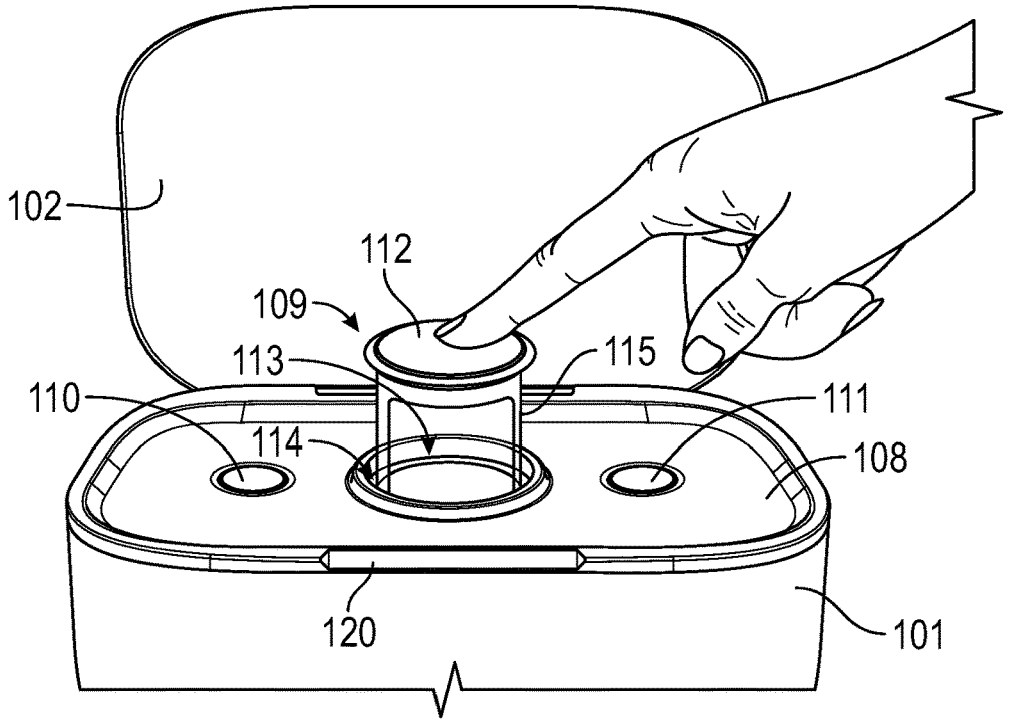

FIG. 1B and FIG. 1C show views of toilet water tank 101 with tank upper lid 102 in an open position, according to an embodiment. Visible is tank lower lid 108. Upper lid may be opened by releasing latch 120 and lifting up. Upper lid 108 is coupled to hinge 121. Positioned in lower lid 108 are first clean cycle button 110 and second clean cycle button 111.

According to an embodiment, first button 110 may be associated with a "quick clean" clean cycle and second button 111 may be associated with a "deep clean" clean cycle. Also positioned in lower lid 108 is cleaning tablet insertion mechanism 109 having cleaning agent chamber 115 and chamber cap 112. Tablet mechanism 109 is configured to lift up when a person presses or pushes cap 112 a first time. Tablet mechanism 109 is shown in a closed inserted position in FIG. 1B, and an open extended position in FIG. 1C. In an open position, opening 113 of chamber 115 is revealed, configured for one to insert a solid cleaning tablet into chamber 115. Chamber cap 112 can be pushed a second time to re-insert chamber to an inserted position as shown in FIG. 1B. Cleaning agent chamber 115 is positioned in chamber housing 114.

Figure 1D:
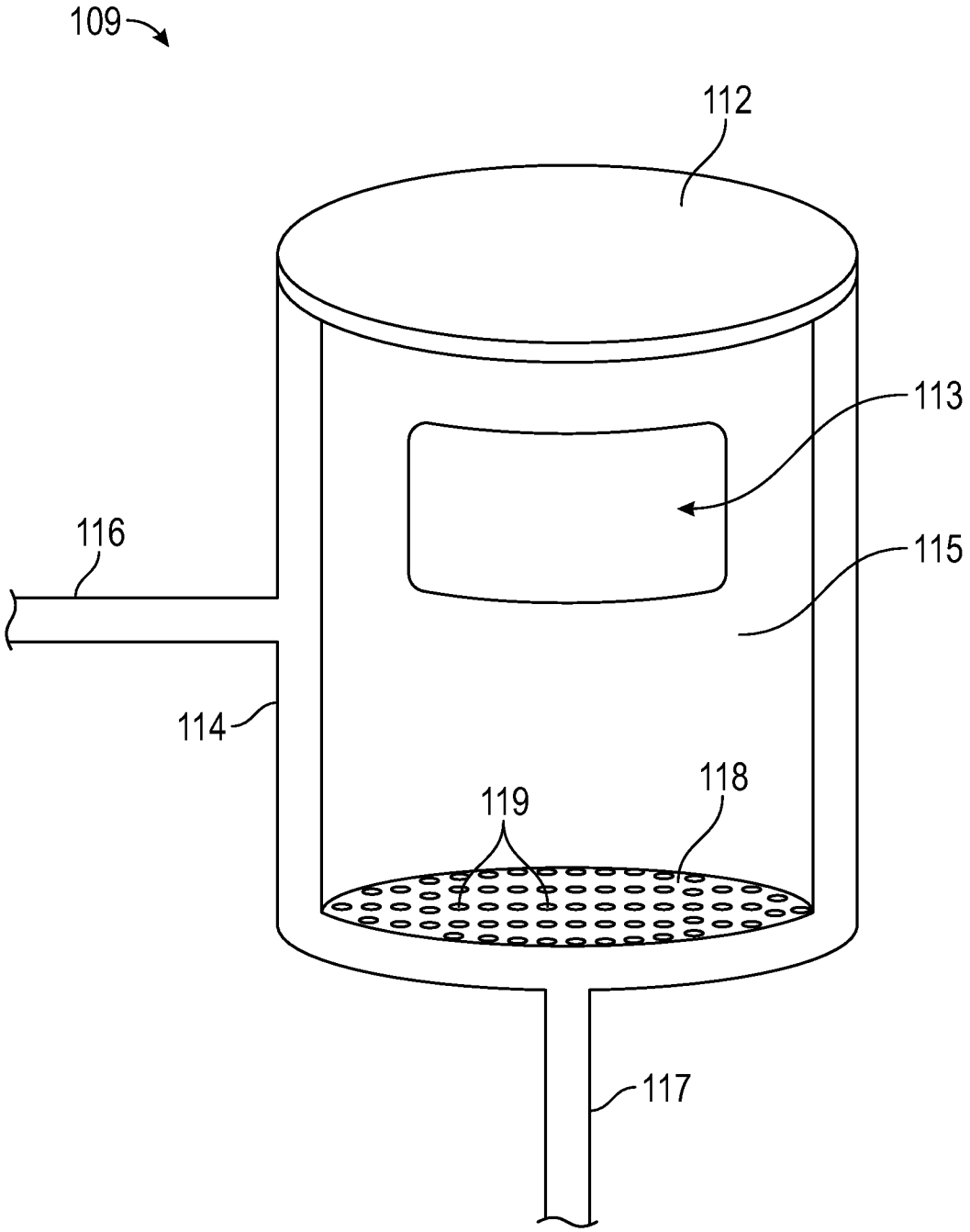
FIG. 1D provides a view of cleaning agent insertion mechanism, according to an embodiment.

FIG. 1D provides a view of cleaning tablet insertion mechanism 109, according to an embodiment. Cleaning agent chamber 115 is shown inserted in housing 114 (shown "see-through"). In an embodiment, a solid cleaning agent tablet may be inserted through opening 113 when chamber 115 is in an extended position. In an embodiment, cleaning agent chamber 115 may comprise a bottom surface 118 having a plurality of holes 119, to allow tank water to mix with and dissolve a solid cleaning agent resting on surface 118. Upon initiation of a cleaning mode, tank water may be directed through housing inlet 116 into housing 114, where it may dissolve a portion of a solid cleaning agent. Dissolved cleaning agent may be directed to a flush valve through housing outlet 117. Inlet 116 may be coupled to an inlet conduit, and outlet 117 may be coupled to an outlet conduit.

In other embodiments, opening 113 of cleaning agent chamber 115 may not be necessary. In such embodiments, cap 112 may be removably coupled to chamber 115, such that it may be removed in order to insert a solid or liquid cleaning agent or cleaning agent concentrate, and re-attached to chamber 115. Cap 112 may for example be threadingly connected to chamber 115 or may be coupled via one or more O-rings. For liquid cleaning agents, housing inlet 116 may not be required. A liquid cleaning agent may be passed through outlet 117. Bottom surface 118 may comprise a plurality of holes, or may comprise a single outlet hole or conduit. One or more of cap 112, chamber 115 or housing 114 may comprise a small vent opening to assist in passing cleaning agent from assembly 109 to a flush valve.

Figure 2:
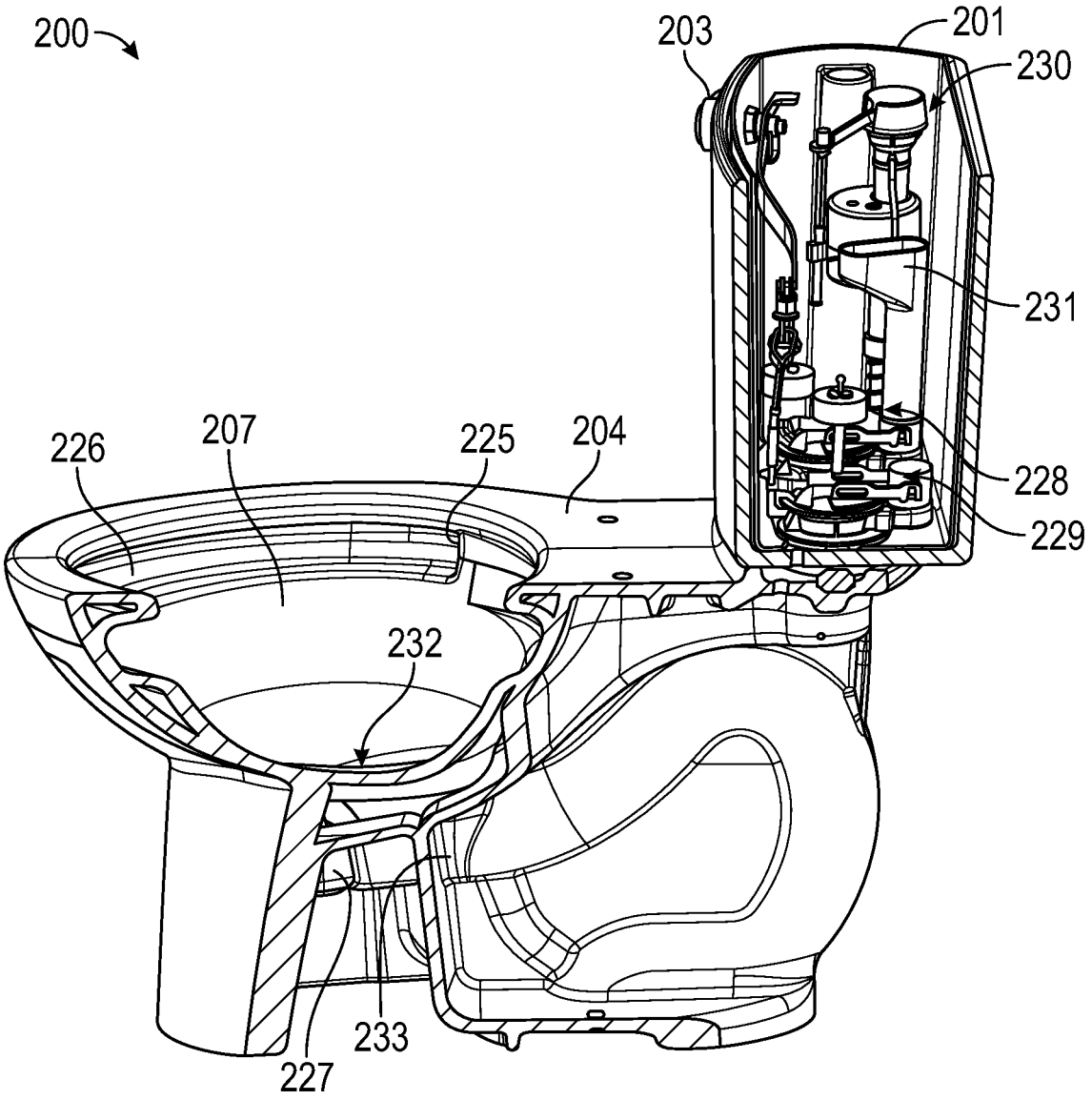
FIG. 2 provides a cross-section view of a toilet assembly, according to some embodiments.

FIG. 2 shows a cross-section view of toilet assembly 200, according to an embodiment. Shown are toilet water tank 201, flush actuator 203, toilet deck 204, and toilet bowl interior surface 207. Assembly may comprise a toilet tank lid and a lower lid. Positioned in toilet tank 201 are rim flush valve assembly 228, jet flush valve assembly 229, and refill valve assembly 230. Overflow tube 231 is coupled to and in flow communication with rim flush valve assembly 228. Rim flush valve assembly 228 is configured to direct flush water through a rim channel to rim outlet 225. Flush water is configured to exit rim outlet 225 and swirl around bowl surface 207 from an upper perimeter of bowl surface 207 towards sump area 232. Rim flush water is configured to clean bowl interior surface 207. Jet flush valve assembly 229 is configured to direct flush water through a jet channel to jet outlet 227, opposite trapway inlet 233. Flush water is configured to exit jet outlet 227, pass through sump area 232, and enter trapway inlet 233, creating a siphon.

Figure 3:
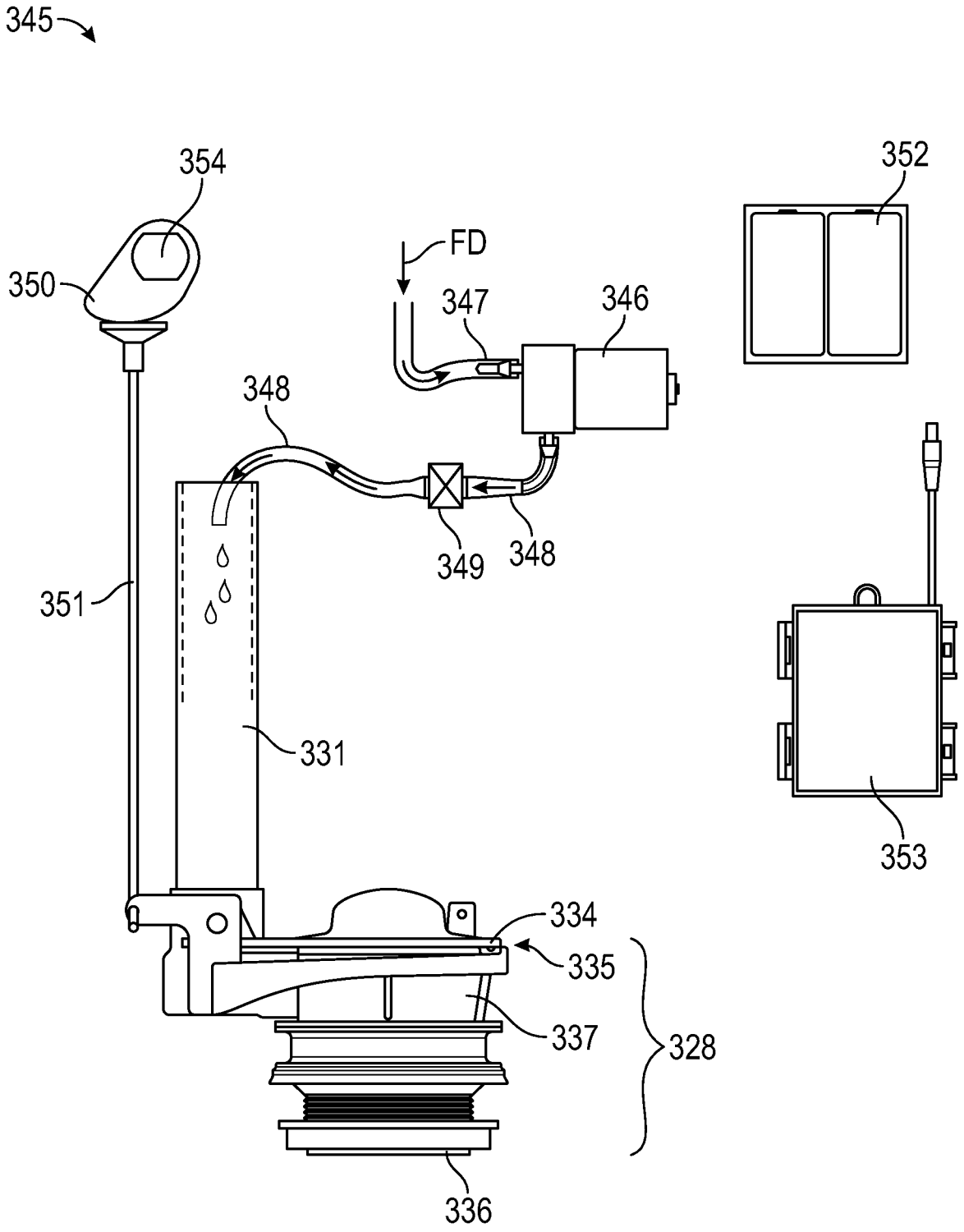
FIG. 3 shows a portion of a bowl cleaning system, according to some embodiments.

FIG. 3 provides a view of a portion of toilet bowl cleaning system 345, according to some embodiments. Flush valve assembly 328 comprises valve body 337, which extends from flush valve inlet 335 to flush valve outlet 336. Flush valve 328 is shown in a closed position with seal 334 positioned over and enclosing inlet 335. Flush valve body 337 is coupled to and in flow communication with overflow tube 331. Cleaning system 345 comprises pump 346, tube 347, tube 348, and check valve 349. Tube 347 is configured to be fluidly connected to a cleaning agent chamber (not shown). A liquid cleaning agent may be configured to flow from a cleaning agent chamber housing in flow direction FD with the aid of pump 346, into overflow tube 331 and into valve body 337. Cleaning system 345 also comprises battery pack 352, controller 353, electric motor 354, lift rod 351, and cam 350. Battery pack 352, controller 353, pump 346, and electric motor 354 are in electrical communication. Controller 353 is also in electrical communication with a clean cycle button.

In an embodiment, upon a person actuating a clean cycle button, for example a quick clean or a deep clean cycle button, controller 353 receives the command and activates pump 346 to pump a predetermined amount of a liquid cleaning agent from a cleaning agent chamber into overflow tube 331. The liquid cleaning agent will pass into flush valve body 337. Controller 353 will then direct motor 354 to turn cam 350, pushing lift rod 351 downward, causing seal 334 to lift, allowing water in a toilet water tank to enter flush valve body 337, and to carry the cleaning agent through one or more rim outlets into a toilet bowl. Controller 353 is configured to direct electric motor 354 to lower seal 334 to close flush valve 328. An amount of water directed to a toilet bowl in a clean cycle is enough to carry a cleaning agent into the bowl, but is not enough to initiate a flush.

A present toilet assembly is configured to operate in a standard flush mode and in an independent cleaning mode. A term "independent" meaning a person may initiate a cleaning mode "on-demand". A flush mode refers to an operation of a gravity flush, wherein bowl contents are cleared from a toilet bowl. A gravity flush may be initiated via a wash-down or siphonic mechanism.

A flush valve assembly is positioned in a toilet water tank and configured to deliver tank water to a toilet bowl. The terms "toilet bowl" and "toilet bowl interior surface" may be interchangeable. A flush valve assembly is configured to deliver flush water to one or more bowl rim outlets. In FIG. 2, assembly 200 is a "rimless" design, having a single rim outlet 225. Flush water is configured to pass from tank 201, through a rim channel in fluid communication with flush valve 228, and exit rim outlet 225 to bowl 207. Flush water exiting outlet 225 is configured to swirl around bowl 207 from an upper perimeter of bowl 207 towards sump area 232 and cover a large surface thereof. In other embodiments, a bowl may comprise a rim having a plurality of rim outlets positioned on an underside thereof, and configured to deliver flush water to a bowl interior surface.

In some embodiments, a toilet assembly may comprise a rim channel and a jet channel. A jet channel may be configured to deliver flush water to a jet outlet positioned in a bowl sump area, opposite a trapway inlet. For example, in FIG. 2, toilet assembly 200 comprises a jet channel in fluid communication with tank 201 and jet outlet 227. In some embodiments, a toilet assembly may comprise a single flush valve configured to deliver flush water to both a rim outlet and a jet outlet. In other embodiments, as shown in FIG. 2, a toilet assembly may comprise a rim flush valve configured to deliver flush water through a rim channel to a rim outlet, and a jet flush valve configured to deliver flush water through a jet channel to a jet outlet.

In some embodiments, a flush mode to clear bowl contents may employ about 1.28 gallons per flush, about 1.0 gallons per flush, about 0.8 gallons per flush, or less. In some embodiments, a present toilet assembly may be configured to direct more than about 50% by volume of flush water from a tank to a rim flow path. In some embodiments, more than about 60% or more than about 70% by volume of flush water may be directed to a rim flow path, relative to a total of flush water delivered to a rim flow path and a jet flow path.

In some embodiments a lid configured to cover a toilet tank comprises an upper lid and a lower lid. An upper lid may be coupled to a hinge configured to allow for rotational opening of an upper lid to reveal a lower lid. A lower lid may comprise and have coupled thereto one or more clean cycle actuators and a cleaning agent chamber. In some embodiments, a lower lid may be coupled to a hinge feature to allow for rotational opening of a lower lid. A lower lid may have a controller, electric wires, and a battery pack coupled to an underside thereof.

In some embodiments, a lower lid may comprise an upper part and a lower part. A lower lid upper part may be coupled to hinge and may be lifted in a similar fashion to a tank upper lid. A space may exist between a lower lid upper part and lower lid lower part, configured to house a battery pack and controller. In this way, a battery may be replaced or accessed for re-charging. A space between a lower lid upper part and lower lid lower part may also house electric wires to provide electronic communication between a controller, a battery pack, and a clean cycle button. In some embodiments, elements positioned in a space within a lower lid may be considered as coupled to the lower lid. In other embodiments, elements may be coupled to an underside of a lower lid and not within a space within a lower lid.

In some embodiments, an entire lid assembly may be configured to be lifted off and removed from a toilet tank like a typical tank lid. Conduits or tubes connected to a cleaning agent chamber housing may have "slack" so that a person may lift a lid to reveal a connected tube. A tube may be removed from a housing so that a lid may be freely removed from a tank.

A clean cycle actuator may comprise a button, lever, capacitive touch, and the like. Upon operating a clean cycle actuator, a signal is sent to a controller (a cleaning request signal). A controller (microcontroller, printed circuit board) may then instruct a valve or pump to operate to send a dose of cleaning agent from a cleaning agent housing to an interior space of a flush valve. Sequentially, or simultaneously, a controller may then instruct the flush valve to open to allow tank flush water to carry the dose of cleaning agent through a rim outlet onto an upper perimeter of a toilet bowl surface, and around the bowl surface. The dose of cleaning agent is carried onto the bowl interior surface as a flush water/cleaning agent mixture.

In some embodiments, there may a first and a second clean cycle actuator. For instance, a first clean cycle actuator may be for operation of a "quick" clean cycle, and a second clean cycle actuator may be for a "deep" clean cycle. Actuation of a quick clean cycle may cause delivery a first dose of cleaning agent to a flush valve interior space, and actuation of a deep clean cycle may cause delivery of a second dose of cleaning agent to a flush valve interior space. A second dose will be larger than a first dose, for instance 2 times, 3 times, 4 times, 5 times, or more larger, by cleaning agent volume or weight.

A flow rate and/or volume of tank water used to carry the dose of cleaning agent into the toilet bowl will be insufficient to initiate a flush to clear a bowl of bowl contents. For example, a flow rate and/or volume of tank water used to carry the dose of cleaning agent will be insufficient to initiate a siphon to clear bowl contents. A controller will then instruct the flush valve to closed, and may instruct the flush valve to remain closed for a period of time. Over this period of time, a water/cleaning agent solution is allowed to remain on a bowl interior surface in order to clean it. After this period of time (cleaning time), a controller may instruct the flush valve to again open to provide new flush water to rinse away the cleaning agent from the bowl surface. A flow rate and/or volume of new tank water used to rinse a bowl interior surface may be insufficient to a flush to clear a bowl of bowl contents, but may be sufficient to rinse the cleaning agent from the bowl interior surface into a water seal in a bowl sump area. In other embodiments, a flow rate and/or volume of new tank water may be sufficient to initiate a flush to clear a bowl of bowl contents.

In some embodiments, a period of time (cleaning time, or cleaning agent residence time), may be programmed to last for example from about 20 seconds, about 40 seconds, or about 1 minute, to any of about 2 minutes, about 4 minutes, about 6 minutes, about 10 minutes, about 15 minutes, about 20 minutes, or more. In some embodiments, an amount of new flush water to rinse away the cleaning agent may be from any of about 0.5 liters, about 1.0 liters, about 1.5 liters, or about 2.0 liters, to any of about 2.5 liters, about 3.0 liters, about 3.5 liters, or more.

In some embodiments, a cleaning time for a deep clean cycle may be longer than for a quick clean cycle, for example about 2 times, about 3 times, about 4 times, about 5 times or more longer.

A flush valve assembly comprises a valve body extending from a valve body inlet to a valve body outlet. A valve inlet and outlet will be in flow communication with a rim channel and a rim outlet. A valve body has an interior space though with tank water may be directed and into which a dose of cleaning agent may be delivered. In some embodiments, a valve body may be coupled to and in flow communication with an overflow tube. In some embodiments, a cleaning agent may be directed through an overflow tube into a valve body interior space. Typically, a toilet assembly will also comprise a refill valve. A refill valve may be configured to automatically refill a toilet bowl to provide a water seal in a sump area towards the end of a flush cycle. A water seal refill may typically be provided through an overflow tube coupled to a flush valve.

A flush cycle is initiated by operation of a flush actuator, comprises flow of tank water through a rim outlet and/or a jet outlet to perform a bowl flush to empty the bowl of bowl contents, and concludes upon a bowl sump area being refilled to form a bowl water seal. An independent clean cycle is initiated by operation of a clean cycle actuator, comprises flow of a dose of cleaning agent to an interior space of a flush valve, and opening of the flush valve to carry the dose of cleaning agent as a water/cleaning agent mixture to the bowl upper perimeter and onto the bowl interior surface. A cleaning cycle may comprise allowing the water/cleaning agent mixture to sit on the bowl surface for a predetermined period of time, and conclude by instructing the flush valve to open after the period of time to rinse the water/cleaning agent mixture from the bowl surface.

A flush valve inlet may be enclosed with a flapper having a sealing surface (a seal). In some embodiments, a flapper may comprise a flexible seal having a bottom surface configured to enclose a flush valve inlet. A flexible seal may comprise one or more rigid parts coupled to a seal top surface. In some embodiments, a seal may be configured to open slowly, or "peel" open from a front towards a back.

Hinged arms or a chain, and the like, may be coupled to a rigid part positioned at a front of a seal top surface, and configured to peel open a flush valve slowly. This may be advantageous for delivery of a water/cleaning agent mixture to a bowl surface.

In some embodiments, a flush valve assembly and/or a flapper may be coupled to a lift arm or lift rod configured to lift a flapper upon command from a controller. In an embodiment, a controller may be electrically coupled to an electric motor which may be coupled to a lift are or lift rod. A controller may send an electronic signal to an electric motor to actuate a lift arm or lift rod to lift a flapper to open a flush valve.

In some embodiments, a flush actuator, configured to initiate a flush cycle, may be manual or electronic. A flush actuator may be in wireless or wired electronic communication with a controller. Upon a person operating a flush actuator, an electronic signal (flush request signal) may be sent to a controller. The controller may then send an instruction to an electric motor coupled to a lift mechanism to initiate a flush. In other embodiments, a flush actuator may be manual and completely independent from an electronic cleaning system. Upon operation of a manual flush actuator, a chain or arm assembly coupled to a flapper may be lifted to raise the flapper to open the flush valve. In some embodiments, an electronic flapper lift assembly employed in a clean cycle may be the same assembly employed in a flush cycle (with differing open time periods).

In some embodiments, a chamber configured to receive a cleaning agent is configured to be in an inserted position in a chamber housing, and in an extended position, where the chamber is extended up out of the housing. A chamber may have top surface, or removably coupled cap positioned on a top surface. A chamber may comprise a cylindrical shape, or may comprise another shape. A chamber may be configured such that upon pressing a chamber top surface a first time, the chamber will move from an inserted position to an extended position. A chamber may be configured such that upon pressing a chamber top surface a second time, the chamber will move from an extended position to an inserted position. A chamber housing may comprise a mechanism to assist in moving a chamber between positions, for example a push-push mechanism or a click-pen mechanism. In other embodiments, a chamber may simply be moved between an inserted position and an extended position by pulling/pushing a cap on a top surface of the chamber. A cap may comprise a grip or handle to assist in moving a chamber between positions. A chamber may comprise an O-ring to couple to a housing interior surface. In general, a housing may comprise a same shape as a chamber.

In some embodiments, a mechanism configured to assist in moving a chamber between inserted and extended positions may include a resilient member and a detent. A resilient member may be configured to resist a person's force when one pushes a chamber top surface to place a chamber in an inserted position, and then can move to an extended position when the person presses the chamber top surface again. In one or more embodiments of the disclosure, a resilient member can include a compression spring, a tension spring, or a torsion spring. Alternatively, rather than employing a spring, a resilient member can include any material that can deform and absorb energy in the presence of a force and revert back to its original form once the force is removed. A detent can include a feature configured to mechanically resist or arrest motion of an object until the detent is released. A detent can act to mechanically resist and arrest the motion of a chamber that would otherwise be returned back to an extended position.

In some embodiments, a chamber may conveniently be re-filled with a liquid or solid cleaning agent by removal of a cap. A cap may have one or more O-rings to couple it to a chamber interior surface. Alternatively, a cap may be threadingly coupled to a chamber. In other embodiments, a chamber in an extended position may reveal an opening configured to receive a solid cleaning agent. Solid cleaning agents include tablets, granules, particles, pods, and the like. Liquid cleaning agents include water-based liquid cleaning agents, cleaning agent concentrates, and the like. In some embodiments, a chamber may be configured to receive multiple tablets, which may last for example up to a year or more.

In some embodiments, a lower end of a chamber may comprise one or more holes or openings configured to provide fluid communication between the chamber and a housing. In some embodiments, a liquid cleaning agent may be allowed to drip or flow through one or more openings into a housing interior. A housing may comprise an outlet, configured to couple to an outlet conduit, for example a flexible tube. Upon receiving a clean cycle instruction, a controller may be configured to instruct an electronic valve to open or a pump to activate to move a dose of cleaning agent from the housing, through a housing outlet, through an outlet conduit, and into an interior space of a flush valve. An electronic valve (solenoid valve) or pump may be coupled to an outlet conduit. In some embodiments, a chamber may comprise a small opening positioned towards an upper end, or a chamber cap may comprise a small opening, configured to operate as a vent to aid in moving cleaning agent from a housing.

In some embodiments, a chamber housing may comprise a housing inlet. A housing inlet may be coupled to an inlet conduit, for example a flexible inlet tube. A cleaning system may be configured to direct tank water through an inlet conduit, through a housing inlet, and into a housing interior. As a chamber may comprise one or more openings positioned towards or at a lower end thereof, tank water in a housing interior may be allowed to dissolve or dilute a solid cleaning agent or a cleaning agent concentrate. A dissolved or diluted cleaning agent may serve to provide a dose of cleaning agent. In some embodiments, a controller may be configured to instruct an electronic valve or pump to operate to move tank water into a housing interior. This may be performed upon receiving a clean cycle request, or after a clean cycle, to be ready for a next clean cycle. A dissolved or diluted cleaning agent may be directed to a flush valve interior as outlined above.

In general, a flow assembly of the cleaning system comprises an outlet conduit, an optional inlet conduit, and one or more electronic valve or pumps associated with the conduits. A flow assembly is configured to move or direct a dose of cleaning agent from a housing to an interior space of a flush valve. A conduit may comprise a flexible tube, which may have slack for removal of a lid from a toilet tank without disturbing a flow assembly positioned in a toilet tank. In some embodiments, a flexible tube may be snap-fit to a housing outlet and inlet.

In some embodiments, a lid comprising an upper lid and a lower lid may comprise a thermoplastic, for instance an engineering thermoplastic. A cleaning agent chamber, cap, and housing may also comprise a thermoplastic, for instance an engineering thermoplastic. Thermoplastics include for example polyphenylene sulfide, a polyphthalamide, a polyamide, a polyester, a polycarbonate, a polyacetal, an acrylonitrile-butadiene-styrene, copolymers thereof, or blends thereof.

In some embodiments, a chamber housing may normally be "dry" between clean cycles, that is, containing essentially no water. For example, when using a solid cleaning agent tablet, tank water may be directed into a housing to dissolve a portion of a tablet. The dissolved liquid portion may be directed to an interior space of a flush valve as a dose of cleaning agent, thereby leaving the housing with little or no liquid between clean cycles. In other embodiments, when employing a solid cleaning agent, a liquid dose of cleaning agent may be present in a housing between clean cycles. For example, upon directing a dose of cleaning agent to an interior space of a flush valve, a set volume of fresh tank water may be directed to the housing to dissolve a portion of a solid cleaning agent to prepare a next dose of cleaning agent.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A self-cleaning toilet assembly comprising
- a toilet bowl;
- a toilet water tank;
- a toilet water tank lid;
- a flush valve assembly; and
- a cleaning system, wherein
- the toilet assembly is configured to operate in a flush mode to perform a flush cycle to clear the toilet bowl of bowl contents,
- the toilet assembly is configured to operate in an independent cleaning mode to perform a clean cycle to clean the toilet bowl,
- the toilet bowl comprises a toilet bowl interior surface,
- the toilet water tank lid is configured to be positioned on and enclose the toilet water tank, the toilet tank lid comprises a upper lid and a lower lid,
- the flush valve assembly comprises a flush valve body having an interior space, a flush valve inlet, a flush valve outlet, and a seal,
- the flush valve assembly is configured to be in a closed position when the seal is positioned over the flush valve inlet,
- the flush valve assembly is configured to be in an open position when the seal is lifted off the flush valve inlet,
- the flush valve assembly is configured to direct toilet tank water through a rim outlet and into the toilet bowl,
- the cleaning system comprises
  - a clean cycle actuator,
  - a chamber configured to receive a cleaning agent,
  - a housing configured to receive the chamber in a housing interior space,
  - a flow assembly, and
  - a controller,
- the clean cycle actuator and the housing are coupled to the lower lid,
- the housing and chamber are in flow communication,
- the clean cycle actuator and the controller are in electrical communication,
- the chamber is configured to be in an inserted position in the housing and to be in an extended position out of the housing,
- the chamber is configured to receive the cleaning agent when in the extended position,
- the cleaning mode comprises
  - operating the clean cycle actuator to send a clean cycle request to the controller,
  - the controller instructing the flow assembly to direct a dose of cleaning agent from the housing to the flush valve body interior space in the flush valve closed position,
  - the controller instructing the flush valve to open to introduce tank water into the rim flush valve body interior space to carry the dose of cleaning agent as a water/cleaning agent mixture through the flush valve outlet, through the rim outlet, and onto the toilet bowl interior surface,
  - the controller instructing the flush valve to close,
- the cleaning mode is configured to operate independently from the flush mode, and
- a flow rate and volume of the water/cleaning agent mixture are insufficient to initiate a flush to clear the toilet bowl of bowl contents.

2. The self-cleaning toilet assembly according to claim 1, wherein
- the cleaning mode comprises instructing the flush valve to close and to remain closed for a period of time,
- the water/cleaning agent mixture is configured to rest on the toilet bowl interior surface for the period of time, and after the period of time, the controller is configured to instruct the flush valve to open to introduce new flush water to wash the water/cleaning agent mixture from the toilet bowl interior surface.

3. The self-cleaning toilet assembly according to claim 2, wherein a flow rate and volume of the new flush water is sufficient to wash the water/cleaning agent mixture from the toilet bowl interior surface, and is insufficient to initiate a flush to clear the toilet bowl of bowl contents.

4. The self-cleaning toilet assembly according to claim 3, wherein a volume of the new flush water is from about 0.5 liters to about 3.5 liters.

5. The self-cleaning toilet assembly according to claim 1, wherein the cleaning system comprises a first clean cycle actuator and a second clean cycle actuator, operation of the first clean cycle actuator results in a first dose of cleaning agent being directed from the housing to the flush valve body interior space in the flush valve closed position, operation of the second clean cycle actuator results in a second dose of cleaning agent being directed from the housing to the flush valve body interior space in the flush valve closed position, and the second dose is greater than the first dose.

6. The self-cleaning toilet assembly according to claim 2, wherein the cleaning system comprises a first clean cycle actuator and a second clean cycle actuator, and the period of time when the second clean cycle actuator is operated is greater than the period time when the first clean cycle actuator is operated.

7. The self-cleaning toilet assembly according to claim 1, wherein the cleaning agent is a liquid, the flow assembly comprises an outlet conduit coupled to a housing outlet, and the flow assembly is configured to direct the dose of cleaning agent to the flush valve body interior space by directing the dose of cleaning agent through the housing outlet, through the outlet conduit, and to the flush valve body interior space.

8. The self-cleaning toilet assembly according to claim 1, wherein the cleaning agent is a liquid or a solid, the flow assembly comprises an inlet conduit coupled to a housing inlet and an outlet conduit coupled to a housing outlet, and the flow assembly is configured to direct the dose of cleaning agent to the flush valve body interior space by directing toilet tank water through the inlet conduit, through the housing inlet, and to the housing interior space, allowing the toilet tank water to dissolve or dilute the cleaning agent to prepare the dose of cleaning agent, directing the dose cleaning agent from the housing interior space, through the housing outlet, and through the outlet conduit, and directing the dose of cleaning agent to the flush valve body interior space.

9. The self-cleaning toilet assembly according to claim 1, wherein the flow assembly comprises an outlet conduit coupled to a housing outlet, the flow assembly comprises a pump in electrical communication with the controller, the pump is coupled to the outlet conduit, and the pump is configured to pump the dose of cleaning agent from the housing interior space to the flush valve body interior space.

10. The self-cleaning toilet assembly according to claim 1, wherein the flow assembly comprises an inlet conduit coupled to a housing inlet, and an outlet conduit coupled to a housing outlet, the flow assembly comprises a first pump and a second pump in electrical communication with the controller, the first pump is coupled to the inlet conduit and the second pump is coupled to the outlet conduit, the first pump is configured to pump toilet tank water from the toilet tank to the housing interior space, and the second pump is configured to pump the dose of cleaning agent from the housing interior space to the flush valve body interior space.

11. The self-cleaning toilet assembly according to claim 1, wherein the flush valve body interior space is in flow communication with an overflow tube, and the flow assembly is configured to direct the dose of cleaning agent through the overflow tube to the flush valve body interior space.

12. The self-cleaning toilet assembly according to claim 1, wherein the flush valve assembly is associated with a flush actuator, the flush actuator is electrically coupled to the controller, operation of the flush actuator sends a flush cycle signal to the controller, and the controller instructs the flush valve assembly to open to perform the flush cycle.

13. The self-cleaning toilet assembly according to claim 1, wherein the cleaning agent chamber comprises an opening configured to receive a solid cleaning agent.

14. The self-cleaning toilet assembly according to claim 1, wherein the cleaning agent chamber is removably coupled to a cap, and wherein the cleaning agent chamber is configured to receive the cleaning agent with the cap removed.

15. The self-cleaning toilet assembly according to claim 1, wherein the cleaning agent chamber comprises a plurality of holes positioned towards a chamber lower end.

16. The self-cleaning toilet assembly according to claim 1, wherein the cleaning agent chamber comprises a cap positioned on a chamber upper end, pushing the cap a first time places the chamber in the extended position, and pushing the cap a second time places the chamber in the inserted position.

17. The self-cleaning toilet assembly according to claim 1, wherein the controller is electrically coupled to a battery, and wherein the controller and the battery are coupled to the lower lid.

18. The self-cleaning toilet assembly according to claim 1, wherein the flush valve assembly is configured to direct flush water through a rim outlet and through a jet outlet.

19. The self-cleaning toilet assembly according to claim 1, wherein the flush valve assembly comprises a rim flush valve assembly and a jet flush valve assembly.

20. The self-cleaning toilet assembly according to claim 18, wherein during a flush cycle, more than about 50 volume percent of total flush water is delivered through the rim outlet.

* * * * *